US006314920B1

(12) United States Patent
Suzuki et al.

(10) Patent No.: US 6,314,920 B1
(45) Date of Patent: Nov. 13, 2001

(54) COOLING APPARATUS FOR LIQUID-COOLED INTERNAL COMBUSTION ENGINE

(75) Inventors: Kazutaka Suzuki, Kariya; Eizou Takahashi, Chiryu, both of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/489,785

(22) Filed: Jan. 24, 2000

(51) Int. Cl.[7] ..... F01P 7/14
(52) U.S. Cl. ..... 123/41.1; 123/41.44; 123/41.12
(58) Field of Search ..... 123/41.1, 41.44, 123/41.12

(56) References Cited

U.S. PATENT DOCUMENTS 4,726,325 * 2/1988 Itakura ..... 123/41.1
5,749,330 5/1998 Inoue et al. .

* cited by examiner

*Primary Examiner*—Tony M. Arganbright
*Assistant Examiner*—Katrina B. Harris
(74) *Attorney, Agent, or Firm*—Harness, Dickey & Pierce, PLC

(57) ABSTRACT

Discharge flow rate of an electric pump is controlled such that a temperature difference between a coolant temperature at a coolant outlet of an engine and a coolant temperature at a coolant inlet of the engine is maintained to be a predetermined value ΔT. Accordingly, the discharge flow rate decreases as the engine load decreases. Therefore, the pump work is reduced, and the temperature distribution of the engine is reduced. Accordingly, the engine durability is improved while the thermal distortion of the engine is prevented and the fuel economy is improved.

5 Claims, 7 Drawing Sheets

FIG. 6

| ENGINE LOAD | | ELECTRIC PUMP (CONSTANT TEMP. DIFFERENCE) | | |
|---|---|---|---|---|
| ENGINE SPEED (rpm) | LOAD | TEMP. DIFFERENCE ΔTw' (°C) | FLOW RATE (L/min) | FLOW RATE COEFFICIENT α (%) |
| 1000 | FULL LOAD | 6.44 | 26.4 | 100.0 |
| | 3/4 | | 22.6 | 85.7 |
| | 1/2 | | 19.5 | 74.0 |
| | 1/4 | | 16.0 | 60.6 |
| | NO LOAD | | 10.0 | 37.9 |
| 2000 | FULL LOAD | 5.43 | 53.5 | 100.0 |
| | 3/4 | | 48.9 | 91.4 |
| | 1/2 | | 43.8 | 81.9 |
| | 1/4 | | 38.8 | 72.6 |
| | NO LOAD | | 26.5 | 49.5 |
| 3000 | FULL LOAD | 4.44 | 80.2 | 100.0 |
| | 3/4 | | 75.7 | 94.4 |
| | 1/2 | | 69.4 | 86.5 |
| | 1/4 | | 63.0 | 78.5 |
| | NO LOAD | | 47.3 | 59.0 |

FIG. 8

| ENGINE LOAD | | HEAT QUANTITY OF COOLING LOSS Qw (kW) | MECHANICAL PUMP (CONSTANT FLOW RATE) | | ELECTRIC PUMP (CONSTANT TEMP. DIFFERENCE) | | |
|---|---|---|---|---|---|---|---|
| ENGINE SPEED (rpm) | LOAD | | TEMP. DIFFERENCE ΔTw (°C) | CIRCULATION FLOW RATE Vw (L/min) | TEMP. DIFFERENCE ΔTw' (°C) | CIRCULATION FLOW RATE Vw (L/min) | Vw'/Vw (%) |
| 1000 | FULL LOAD | 11.56 | 6.44 | 26.4 | 6.44 | 26.4 | 100.0 |
| | 3/4 | 9.91 | 5.52 | | | 22.6 | 85.7 |
| | 1/2 | 8.56 | 4.77 | | | 19.5 | 74.0 |
| | 1/4 | 7.00 | 3.90 | | | 16.0 | 60.6 |
| | NO LOAD | 4.38 | 2.44 | | | 10.0 | 37.9 |
| 2000 | FULL LOAD | 19.77 | 5.43 | 53.5 | 5.43 | 53.5 | 100.0 |
| | 3/4 | 18.06 | 4.96 | | | 48.9 | 91.4 |
| | 1/2 | 16.20 | 4.45 | | | 43.8 | 81.9 |
| | 1/4 | 14.35 | 3.94 | | | 38.8 | 72.6 |
| | NO LOAD | 9.79 | 2.69 | | | 26.5 | 49.5 |
| 3000 | FULL LOAD | 24.20 | 4.44 | 80.2 | 4.44 | 80.2 | 100.0 |
| | 3/4 | 22.85 | 4.19 | | | 75.7 | 94.4 |
| | 1/2 | 20.93 | 3.84 | | | 69.4 | 86.5 |
| | 1/4 | 19.00 | 3.48 | | | 63.0 | 78.5 |
| | NO LOAD | 14.28 | 2.62 | | | 47.3 | 59.0 |

COOLING APPARATUS FOR LIQUID-COOLED INTERNAL COMBUSTION ENGINE

CROSS-REFERENCE TO RELATED APPLICATION

This application relates to Japanese Patent Application No. Hei. 10-214492 filed Jul. 29, 1998, the entire contents of which are incorporated herein by reference.

BACKGROUND OF THE INVENTION

1. Field of the Invention

The present invention relates to a cooling apparatus for liquid-cooled internal combustion engine, and it is preferably applicable to an internal combustion engine of a vehicle.

2. Description of Related Art

As disclosed in JP-A-8-128559, it is known to maintain the cooling water temperature under light engine load higher than that under heavy engine load in order to improve the fuel consumption performance of a liquid-cooled internal combustion engine (hereinafter referred to as the "engine").

Since a circulating pump for circulating the cooling water is generally driven by the engine, the circulation flow rate of the cooling water which circulates through the engine varies in proportion to the engine speed as shown in FIG. 9. On the other hand, the cooling water temperature increases according to a decrease of the circulation flow rate. Accordingly, the circulation flow rate can be reduced by reducing the pump rotation speed when the engine load is light, because the cooling water temperature can be increased when the engine load is light.

According to the pump driven by the engine, the pump work is allowed to be small by reducing the circulation flow rate when the engine load is light. However, since the circulation flow rate is not variable according to the engine load, unnecessary pump work increases.

SUMMARY OF THE INVENTION

The present invention is made in light of the above-mentioned problem, and it is an object of the present invention to provide a cooling apparatus which decreases unnecessary pump work.

According to a cooling apparatus of the present invention, it includes a radiator for cooling a coolant circulating between a liquid-cooled internal combustion engine and the radiator. Furthermore, the cooling apparatus includes a pump driven independently from the liquid-cooled internal combustion engine for circulating the coolant between the liquid-cooled internal combustion engine and the radiator such that a temperature difference between a coolant temperature at a coolant outlet of the liquid-cooled internal combustion engine and a coolant temperature at a coolant inlet of the liquid-cooled internal combustion engine is maintained to be a predetermined value.

Accordingly, the circulation flow rate decreases as the load of the liquid-cooled internal combustion engine decreases. Thus, unnecessary pump work is reduced.

Further, since the coolant circulates such that a temperature difference between a coolant temperature at a coolant outlet of the liquid-cooled internal combustion engine and a coolant temperature at a coolant inlet of the liquid-cooled internal combustion engine is maintained to be a predetermined value, the temperature distribution of the liquid-cooled internal combustion engine is reduced. Accordingly, since the thermal distortion of the liquid-cooled internal combustion engine is prevented, the fuel economy is improved, and the engine durability is improved.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

FIG. 6 is a control map showing details of FIG. 5 according to the embodiment of the present invention;

FIG. 8 is a map showing various characteristics, such as circulation flow rate, of an electric pump and a mechanical pump according to the embodiment of the present invention.

DETAILED DESCRIPTION OF PREFERRED EMBODIMENT

A cooling apparatus for a liquid-cooled internal combustion engine according to an embodiment of the present invention is applied to a water-cooled engine of a vehicle.

Figure 1:
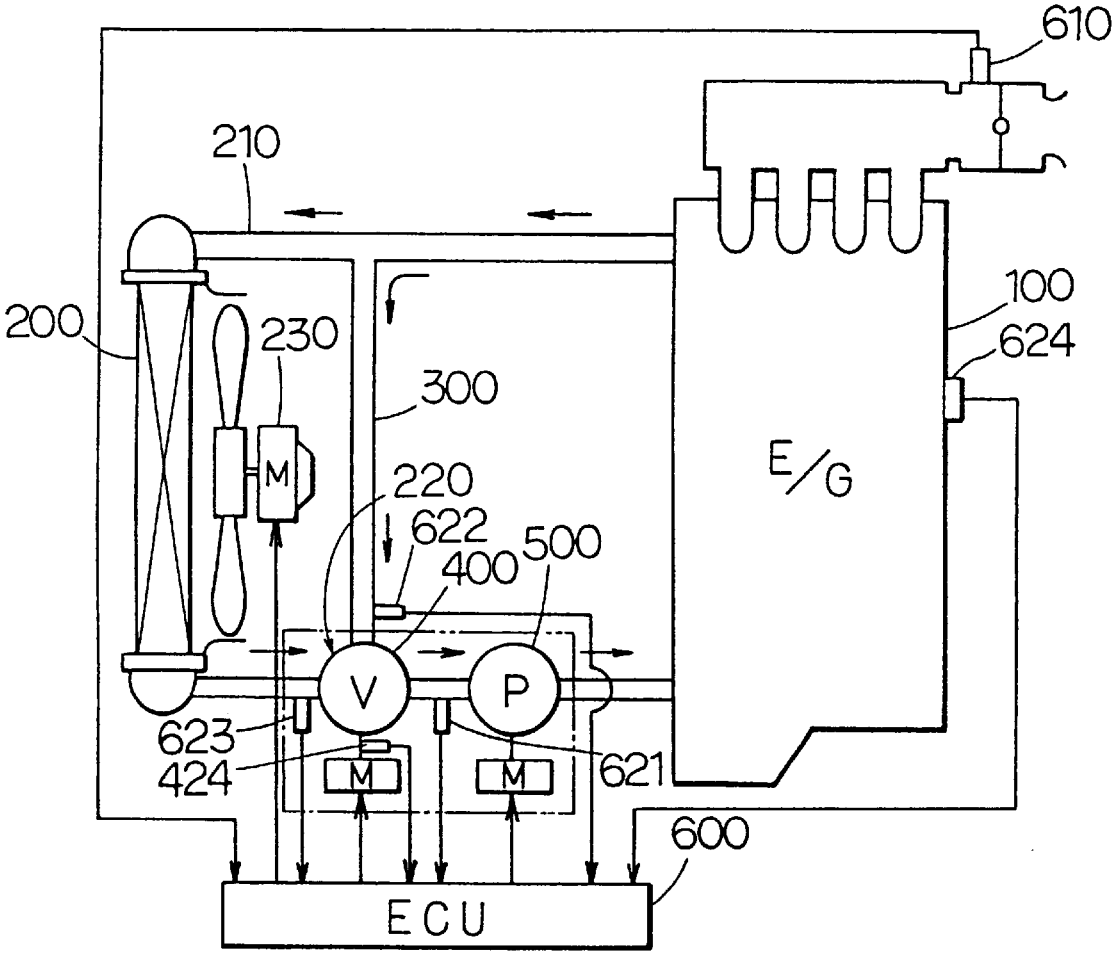
FIG. 1 is a schematic illustration showing a cooling apparatus according to a preferred embodiment of the present invention.

In FIG. 1, a radiator 200 cools cooling water (coolant) which circulates in the water-cooled engine 100. The cooling water circulates through the radiator 200 via a radiator passage 210.

A part of the cooling water flowing out from the engine 100 can be introduced to an outlet side of the radiator 200 at the radiator passage 210 by bypassing the radiator 200 via a bypass passage 300. A rotary-type flow control valve 400 is provided at a junction 220 between the bypass passage 300 and the radiator passage 210 to control the flow rate of the cooling water passing through the radiator passage 210 (hereinafter referred to as "the radiator flow rate Vr") and the flow rate of the cooling water passing through the bypass passage 300 (hereinafter referred to as "the bypass flow rate Vb").

An electric pump 500 for circulating the cooling water which is operated independently from the engine 100 is provided at a downstream side of the flow control valve 400 with respect to the water flow direction.

Figure 2B:
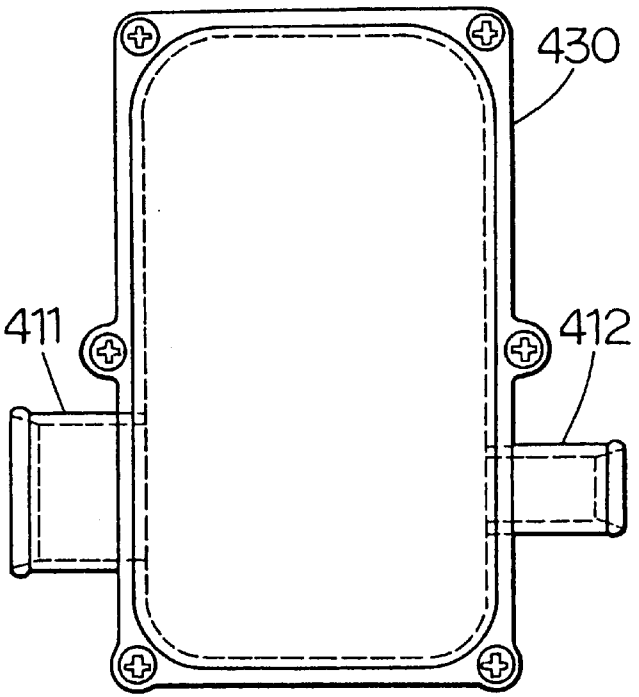
FIG. 2B is a plan view showing the integration of the flow control valve and the pump according to the embodiment of the present invention.
Figure 2A:
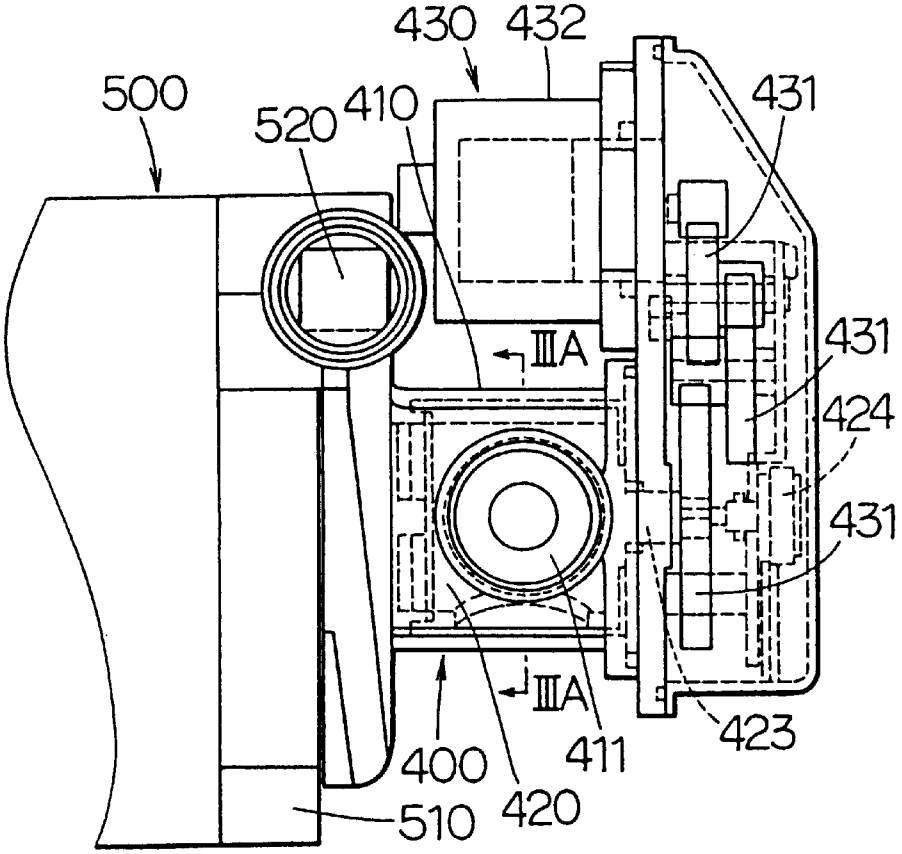
FIG. 2A is a perspective side view showing an integration of a flow control valve and a pump according to the embodiment of the present invention.

As shown in FIGS. 2A and 2B, the flow control valve 400 and the pump 500 are integrated together via a pump housing 510 and a valve housing 410. The valve housing 410 and the pump housing 510 are made of resin.

As shown in FIGS. 2A to 3B, a cylindrically-shaped rotary valve 420 having an opening at one end thereof (shaped like a cup) is rotatably housed in the valve housing 410. The valve 420 is rotated around its rotary shaft by an actuator 430 having a servo motor 432 and a speed reducing mechanism comprising several gears 431.

Figure 3A:
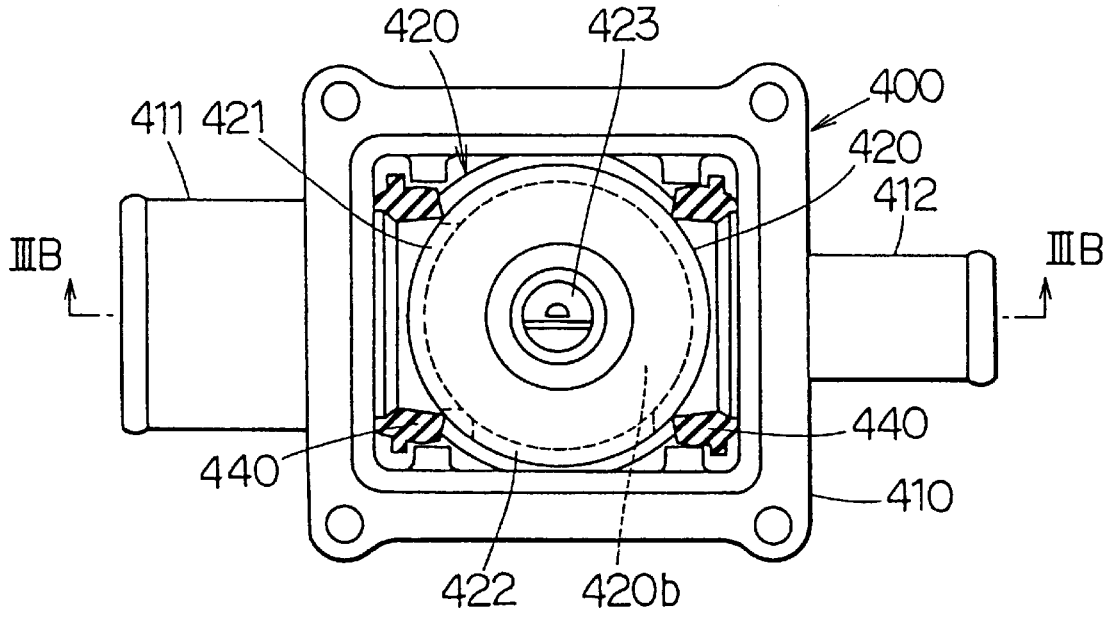
FIG. 3A is a partially sectional view taken on the line IIIA—IIIA in FIG. 2A according to the embodiment of the present invention.
Figure 3B:
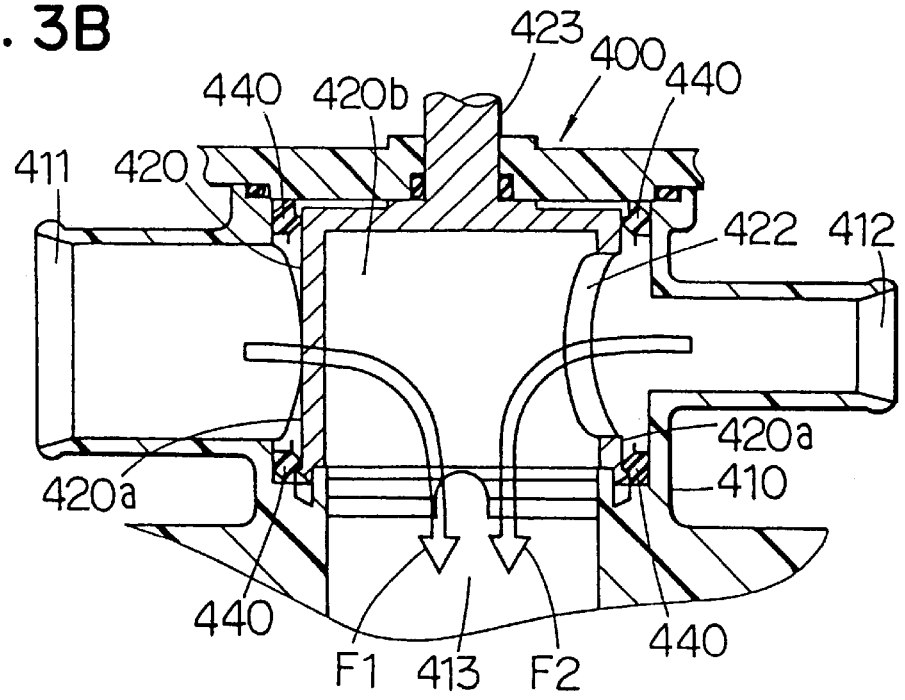
FIG. 3B is a part of a sectional view taken on the line IIIB—IIIB in FIG. 3A according to the embodiment of the present invention.

As show in FIG. 3A, a first valve port 421 and a second valve port 422, having the identical diameter to each other to communicate the inside with the outside of a cylindrical side surface 420*a*, are formed on the cylindrical side surface 420*a* of the valve 420. The valve port 421 is deviated from the valve port 422 by about 90°.

A radiator port (radiator side inlet) 411 communicating with the radiator passage 210 and a bypass port (bypass side inlet) 412 communicating with the bypass passage 300 are formed on a part of the valve housing 410 which corresponds to the cylindrical side surface 420*a*. Further, a pump port (outlet) 413 for communicating the suction side of the pump 500 with a cylindrical inner portion 420*b* of the valve 420 is formed on a part of the valve housing 410 which corresponds to an axial end of the rotary shaft of the valve 420.

A packing 440 seals a gap between the cylindrical side surface 420*a* and the inner wall of the valve housing 410 to prevent the cooling water flowing into the valve housing 410 via the radiator port 411 and the bypass port 412 from bypassing the cylindrical inner portion 420*b* of the valve 420 and flowing to the pump port 413.

As shown in FIG. 2A, a potentiometer 424 is provided on a rotary shaft 423 of the valve 420 to detect a rotary angle of the valve 420, that is a valve opening degree of the flow control valve 400. Detected signals at the potentiometer 424 are input to later described ECU 600.

Electronic control unit (ECU) 600 controls the flow control valve 400 and the pump 500. Detected signals from a pressure sensor 610, a first, second and third water temperature sensors 621, 622 and 623 and a rotary sensor 624 are input to ECU 600. The pressure sensor 610 detects the manifold vacuum of the engine 100. The first through third water temperature sensors 621 to 623 detect the cooling water temperature. The rotary sensor 624 detects the engine speed of the engine 100. ECU 600 controls the flow control valve 400, the pump 500 and the blower 230 based on these detected signals.

Figure 4:
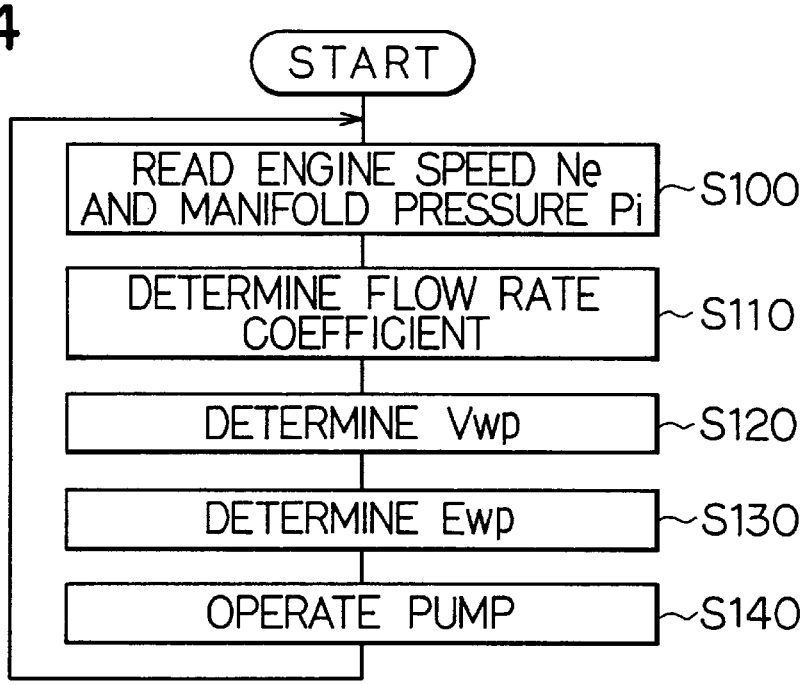
FIG. 4 is a flowchart showing operations of the cooling apparatus according to the embodiment of the present invention.

The operations of the pump 500 will now be described based on a flowchart shown in FIG. 4.

When the engine 100 starts after turning on an ignition switch (not shown) of the vehicle, the detected signals of the pressure sensor 610 and the rotary sensor 624 are read by ECU 600 in step S100.

Figure 5:
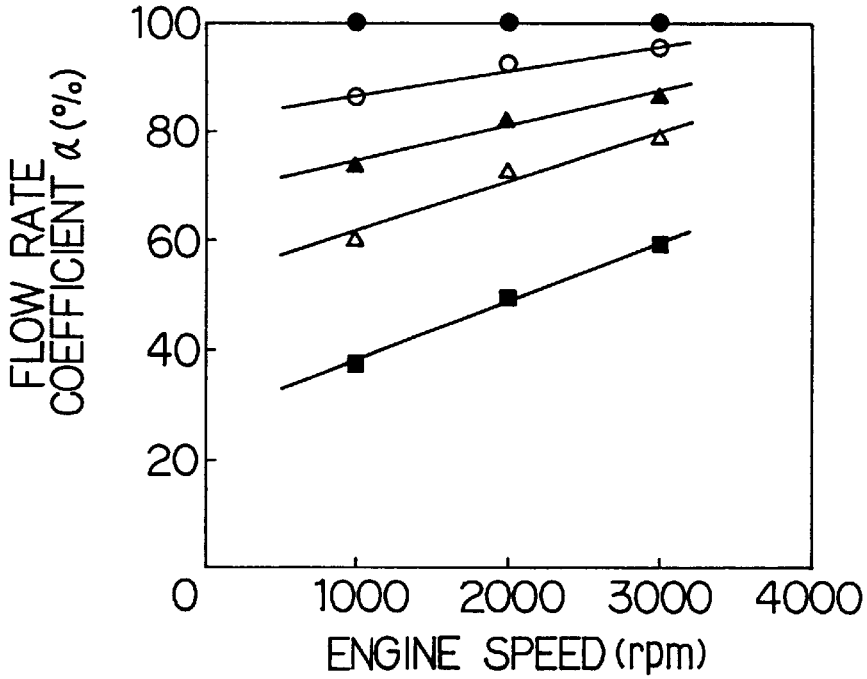
FIG. 5 is a graph showing a relation between flow rate coefficient and engine speed according to the embodiment of the present invention.

In step S1 0, flow rate coefficient $\alpha$ is determined from a map shown in FIG. 5 based on the detected engine speed and the manifold pressure. It is to be noted that the detected value of the pressure sensor 610 corresponds to engine load. The map shown in FIG. 5 is made by obtaining various engine speeds and engine loads from tests such that the temperature difference between the cooling water temperature at the cooling water outlet side of the engine 100 (outlet water temperature) and the cooling water temperature at the cooling water inlet side of the engine 100 (inlet water temperature) is a predetermined temperature difference $\Delta T$, as shown in FIG. 6. The flow rate shown in FIG. 6 coincides with the later described target flow rate $V_{WP}$.

In step S120, target discharge flow rate $V_{WP}$ (circulation flow rate of the cooling water circulating the engine 100) of the pump 500 is determined based on the following Equation 1.

$$V_{WP}=a\cdot Ne\cdot\alpha \qquad \text{[Equation 1]}$$

where "a" represents a coefficient and Ne represents engine speed (rpm).

In step S130, applied voltage $E_{WP}$, of the pump 500 to achieve the target discharge flow rate $V_{WP}$ is determined based on the following Equation 2.

$$E_{WP}=b_1\cdot(V_{WP})^n+b_2\cdot(V_{WP})^{n-1}++b_n\cdot(V_{WP})+c \qquad \text{[Equation 2]}$$

where $b_1$, $b_2$, . . . , $b_n$ and c represent coefficients.

In step S140, the applied voltage $E_{WP}$ determined in step S130 is applied to the pump 500, and returns to step S100.

It is to be noted that the detected values of the first through third water temperature sensors 621–623 are detected to control the opening degree of the control valve 400, and are not directly used for controlling the pump 500 in this embodiment.

Figure 7:
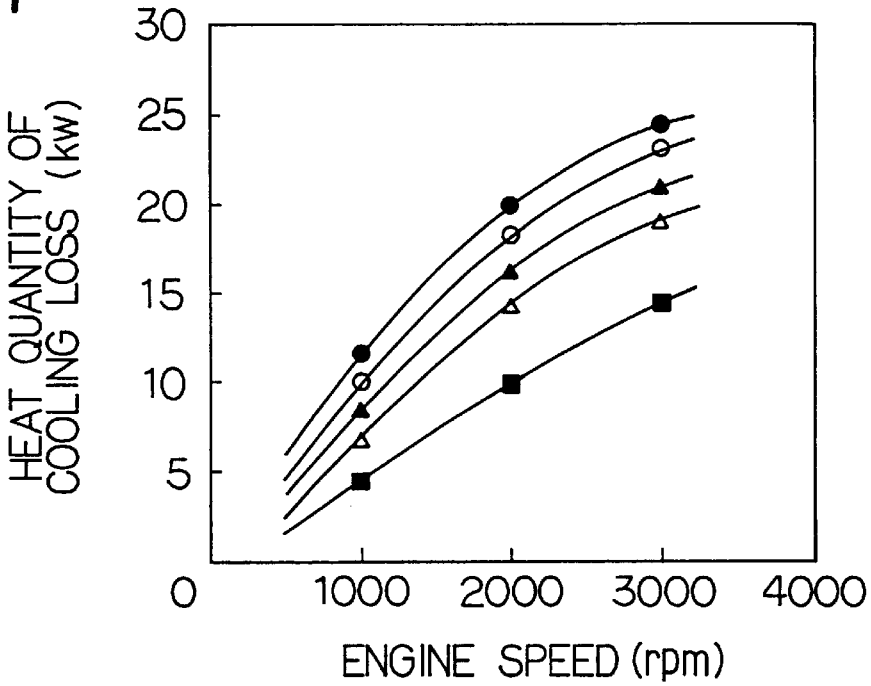
FIG. 7 is a graph showing a relation between heat quantity of cooling loss and engine speed according to the embodiment of the present invention.
Figure 9:
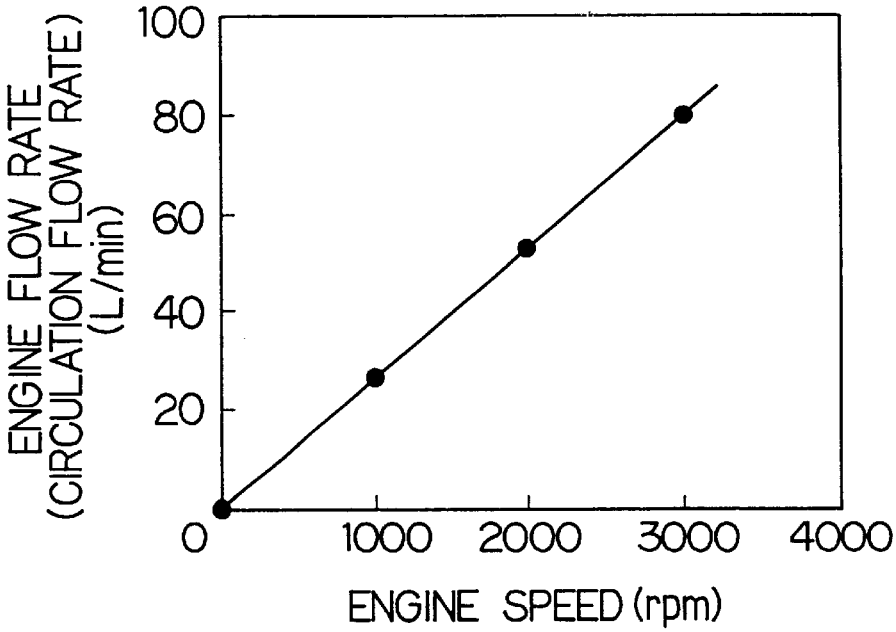
FIG. 9 is a graph showing a relation between the circulation flow rate and the engine speed according to the embodiment of the present invention.

In FIGS. 5 and 7, black circle represents the full load, white circle represents three quarters of the full load, black triangle represents half of the full load, white triangle represents a quarter of the full load, and black rectangle represents no load.

According to the embodiment of the present invention, when engine load increases, generated heat quantity of the engine 100 increases along with the increase of the fuel supplied to the engine 100. Accordingly, the temperature difference between the temperature of the engine 100, that is a temperature of the cylinder, cylinder head or the like, and the cooling water temperature increases, and the heat quantity (heat quantity of cooling loss) given to the cooling water from the engine 100 increases as shown in FIG. 7, and a overheat of the engine 100 is prevented.

If the engine speed is constant, the heat quantity of cooling loss also increases as shown in FIGS. 7 and 8 according to the engine load increase. According to the embodiment, however, the temperature difference between the outlet water temperature and the inlet water temperature is maintained approximately constant, regardless of the engine load as shown in FIG. 8. According to a conventional cooling apparatus having a mechanical pump driven by the engine, however, since the discharge flow rate (circulation flow rate) does not change according to the engine load, the circulation flow rate per a certain amount of heat quantity of cooling loss increases as the engine load decreases.

Since pressure loss (discharge pressure of the pump) of the water circulation system increases in proportion to about flow rate squared, pumping work of the conventional cooling apparatus having the mechanical pump is greater than that of the present invention. Therefore, according to the cooling apparatus of the preferred embodiment, the pumping work is reduced, and the cooling water temperature is suitably controlled according to the engine load. Furthermore, since the temperature distribution of the engine 100 is reduced, the thermal distortion of the engine 100 is prevented, and the engine durability is improved while the fuel economy is improved.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A cooling apparatus for an entire liquid-cooled internal combustion engine using a coolant, comprising:

a radiator for cooling the coolant circulating between the entire liquid-cooled internal combustion engine and said radiator; and a pump driven independently from the entire liquid-cooled internal combustion engine for circulating the coolant between the entire liquid-cooled internal combustion engine and said radiator;

control means for controlling a discharge flow amount of said pump, wherein said control means calculates a target discharge flow amount of said pump for maintaining a predetermined temperature difference between a coolant temperature at a coolant outlet of the entire liquid-cooled internal combustion engine and a coolant temperature at a coolant inlet of the entire liquid-cooled internal combustion engine, and said control means controls the discharge flow amount of said pump to be the target discharge flow amount.

2. A cooling apparatus as in claim 1, wherein said predetermined value is determined based on an engine speed of the liquid-cooled internal combustion engine.

3. A cooling apparatus as in claim 1, wherein said pump is driven electrically.

4. A cooling apparatus according to claim 1, further comprising:

a bypass passage for introducing the coolant flowing from the entire liquid-cooled internal combustion engine to an outlet side of said radiator directly to bypass said radiator; and a flow control valve having a bypass side inlet through which the coolant having passed through said bypass passage flows in, and a radiator side inlet through which the coolant having passed through said radiator flows in, and an outlet for discharging the coolant to the entire liquid-cooled internal combustion engine, for controlling a flow rate of the coolant passing through said bypass passage and the coolant passing through said radiator by changing an opening degree of said flow control valve, wherein said control means further controls the opening degree of said flow control valve for maintaining the temperature difference between the coolant temperature at the coolant outlet of the entire liquid-cooled internal combustion engine and the coolant temperature at the coolant inlet of the entire liquid-cooled internal combustion engine at the predetermined temperature.

5. A cooling apparatus for a liquid-cooled internal combustion engine using a coolant, said cooling apparatus comprising:

a single radiator for cooling all of the coolant circulating between the liquid-cooled internal combustion engine and said cooling apparatus;

a single pump driven independently from the liquid-cooled internal combustion engine for circulating all of the coolant between the liquid-cooled internal combustion engine and said cooling apparatus;

means for controlling a discharge flow amount of said single pump; wherein:

said control means calculates a target discharge flow amount of said single pump for maintaining a predetermined temperature difference between a coolant temperature at a coolant outlet of said liquid-cooled internal combustion engine and a coolant temperature at a coolant inlet of said liquid-cooled internal combustion engine; and said control means controls the discharge flow amount of said pump to be the target discharge flow amount.

* * * * *